US009579589B1

(12) United States Patent
Lee et al.

(10) Patent No.: US 9,579,589 B1
(45) Date of Patent: Feb. 28, 2017

(54) BLOCK ASSEMBLY

(71) Applicants: Sangkil Lee, Seoul (KR); Youngsoon Kim, Yongin-si (KR)

(72) Inventors: Sangkil Lee, Seoul (KR); Youngsoon Kim, Yongin-si (KR)

( * ) Notice: Subject to any disclaimer, the term of this patent is extended or adjusted under 35 U.S.C. 154(b) by 0 days.

(21) Appl. No.: 15/218,291

(22) Filed: Jul. 25, 2016

(30) Foreign Application Priority Data

Aug. 4, 2015 (KR) ..... 10-2015-0109983

(51) Int. Cl.
*A63H 33/04* (2006.01)
*A63H 33/10* (2006.01)

(52) U.S. Cl.
CPC ..... *A63H 33/105* (2013.01); *A63H 33/044* (2013.01); *A63H 33/10* (2013.01)

(58) Field of Classification Search
CPC ..... A63H 33/04; A63H 33/10; A63H 33/105; A63H 33/108
See application file for complete search history.

(56) References Cited

U.S. PATENT DOCUMENTS 1,400,066 A * 12/1921 Huck ..... A63H 33/107 135/909
2,156,155 A * 4/1939 Howard ..... A63H 33/107 446/113
2,683,329 A * 7/1954 Kobler ..... A63H 33/101 403/171
3,153,299 A * 10/1964 Jennings ..... G09B 25/04 403/173
5,803,782 A * 9/1998 Selton ..... A47B 47/0016 446/125
6,390,719 B1 * 5/2002 Chan ..... E04B 1/5806 403/205
7,044,825 B2 * 5/2006 Glickman ..... A63H 33/102 446/121
7,340,868 B2 * 3/2008 Weber ..... E04B 1/2604 403/363
2010/0285718 A1 * 11/2010 Stone ..... A63H 33/008 446/124
2014/0045403 A1 * 2/2014 Murphy ..... A63H 33/08 446/124

* cited by examiner

*Primary Examiner* — John Ricci
(74) *Attorney, Agent, or Firm* — KORUS Patent, LLC; Seong Il Jeong

(57) ABSTRACT

The present disclosure provides a block assembly applied not only to an educational purpose for children but also to a model architecture and a simple real building, etc. In one aspect, there is provided a block assembly comprising: a plurality of first-rods, each first-rod having a first cross sectional area, wherein each first-rod is solid or hollow; a plurality of second-rods, each second-rod having a second cross sectional area larger than the first cross sectional area, wherein each second-rod is solid or hollow; a plurality of H shaped beams, each having a H shaped cross section; and at least one of first to fourth unit blocks.

15 Claims, 19 Drawing Sheets

BLOCK ASSEMBLY

CROSS-REFERENCE TO RELATED APPLICATION

This application claims the benefit of Korea Patent Application No. 10-2015-0109983, filed on Aug. 4, 2015, the entire content of which is incorporated herein by reference for all purposes as if fully set forth herein.

BACKGROUND

Field of the Present Disclosure

The present disclosure relates to a block assembly and, more particularly, to a block assembly applied, for example, to an educational purpose for children and a model architecture and a simple real building.

Discussion of the Related Art

A block set may be used to make a desired structure by assembling various shapes of blocks.

The block set has been used for an educational purpose for children. This may improve attention, observation, understanding, creativity skills necessary for cognitive development for the children.

However, a conventional block assembly set is limited to the educational purpose for children.

The prior art block set may be disclosed in following documents:

Patent document 1: Korean patent application number 10-2005-0064848;

Patent document 2: Korean patent application number 10-2006-0012713;

Patent document 3: Korean utility model application number 20-1997-0004236; and

Patent document 4: Korean utility model application number 20-2001-0022647.

SUMMARY

Thus, the present disclosure provides a block assembly applied not only to an educational purpose for children but also to a model architecture and a simple real building, etc.

In one aspect, there is provided a block assembly comprising: a plurality of first-rods, each first-rod having a first cross sectional area, wherein each first-rod is solid or hollow; a plurality of second-rods, each second-rod having a second cross sectional area larger than the first cross sectional area, wherein each second-rod is solid or hollow; a plurality of H shaped beams, each having a H shaped cross section; and at least one of first to fourth unit blocks; wherein the first unit block includes: a first hexahedral body having first to sixth side faces; a first H shaped beam receiving groove defined in the first body from the first side face to receive the H shaped beam; a first main protrusion protruding from the second side face opposite the first side face to be selectively coupled to the first-rod and second-rod; and at least one of multiple first secondary protrusions protruding from the third to sixth side faces of the first hexahedral body respectively to be selectively coupled to the first-rod and second-rod, wherein the second unit block includes: a second hexahedral body having first to sixth side faces; a second H shaped beam receiving groove defined in the second body from the first side face to receive the H shaped beam therein; a second main protrusion extending from the second side face opposite the first side face to be selectively coupled to the first-rod and second-rod; and at least one of multiple second secondary protrusions extending from the third to sixth side faces respectively to be coupled to the H shaped beam, wherein the third unit block includes: a third hexahedral body having first to sixth side faces; a third H shaped beam receiving groove formed in the third hexahedral body from the first side face to receive the H shaped beam; a third main protrusion extending from the second side face opposite the first side face to be selectively coupled to the first-rod and second-rod; at least one of multiple third secondary protrusions extending from the third to fifth side faces respectively to be selectively coupled to the first-rod and second-rod; and a third H shaped beam coupling protrusion extending from the sixth face to be coupled to the H shaped beam, wherein the fourth unit block includes: a fourth hexahedral body having first to sixth side faces; a fourth H shaped beam receiving groove formed in the fourth body from the first side face to receive the H shaped beam; a fourth main protrusion extending from the second side face opposite the first side, wherein the fourth main protrusion has a fourth H shaped beam receiving groove defined therein; and at least one of multiple fourth secondary protrusions extending from the third to sixth side faces respectively to be coupled to the H shaped beam.

In one implementation, the first main protrusion includes: a first main first-rod coupling protrusion to be coupled to the first-rod; and a first main second-rod coupling protrusion concentric with the first main first-rod coupling protrusion and surrounding the first main first-rod coupling protrusion, wherein the first main second-rod coupling protrusion is coupled to the second-rod.

In one implementation, the first secondary protrusion includes: a first secondary first-rod coupling groove in which the first-rod is vertically inserted; and a first secondary second-rod coupling groove concentric with the first secondary first-rod coupling groove and formed radially outside of the first secondary first-rod coupling groove, wherein the second-rod is horizontally inserted into the first secondary second-rod coupling groove from an open side end thereof.

In one implementation, each of the first secondary first-rod coupling groove portion and the first secondary second-rod coupling groove portion has a stopper protrusion.

In one implementation, the multiple first secondary protrusions have the same shape, and wherein the first unit block has first through-holes formed in the multiple first secondary protrusions to reduce a weight.

In one implementation, the second main protrusion includes: a second main first-rod coupling protrusion to be coupled to the first-rod; and a second main second-rod coupling protrusion concentric with the second main first-rod coupling protrusion and surrounding the second main first-rod coupling protrusion, wherein the second main second-rod coupling protrusion is coupled to the second-rod.

In one implementation, the multiple second secondary protrusions have the same shape, and each of the multiple second secondary protrusions of the second unit block have second through-holes formed therein to reduce a weight.

In one implementation, the third main protrusion includes: a third main first-rod coupling protrusion coupled to the first-rod; and a third main second-rod coupling protrusion concentric with the third main first-rod coupling protrusion and surrounding the third main first-rod coupling protrusion, wherein the third main second-rod coupling protrusion is coupled to the second-rod.

In one implementation, each of the third secondary protrusions includes: a third secondary first-rod coupling groove into which the first-rod is vertically inserted; and a third secondary second-rod coupling groove concentric with the third secondary first-rod coupling groove and formed radially out of the third secondary first-rod coupling groove, wherein the second-rod is horizontally inserted into the third secondary second-rod coupling groove from one open side end thereof.

In one implementation, each of the third secondary first-rod coupling groove portion and the third secondary second-rod coupling groove portion has a stopper protrusion.

In one implementation, the multiple third secondary protrusions have the same shape, and each of the multiple third secondary protrusions has third through-holes formed therein to reduce a weight.

In one implementation, the multiple fourth secondary protrusions have the same shape and each of the multiple fourth secondary protrusions fourth through-holes defined therein to reduce a weight.

In one implementation, the assembly further comprises a beam connection, wherein the beam connection is configured to connect at least two H shaped beams in a linear and/or perpendicular way.

In one implementation, the beam connection includes: a hollow frame; a first H shaped beam through-hole formed in the hollow frame at a first side face; and a second H shaped beam through-holes formed in the hollow frame at a second side face opposite the first side face, wherein the second H shaped beam through-holes is diagonal to the first H shaped beam through-holes.

In one implementation, from the first H shaped beam through-hole portion, a first rib protrudes, wherein in the second H shaped beam through-hole portion, a second rib is recessed.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

Figure 1:
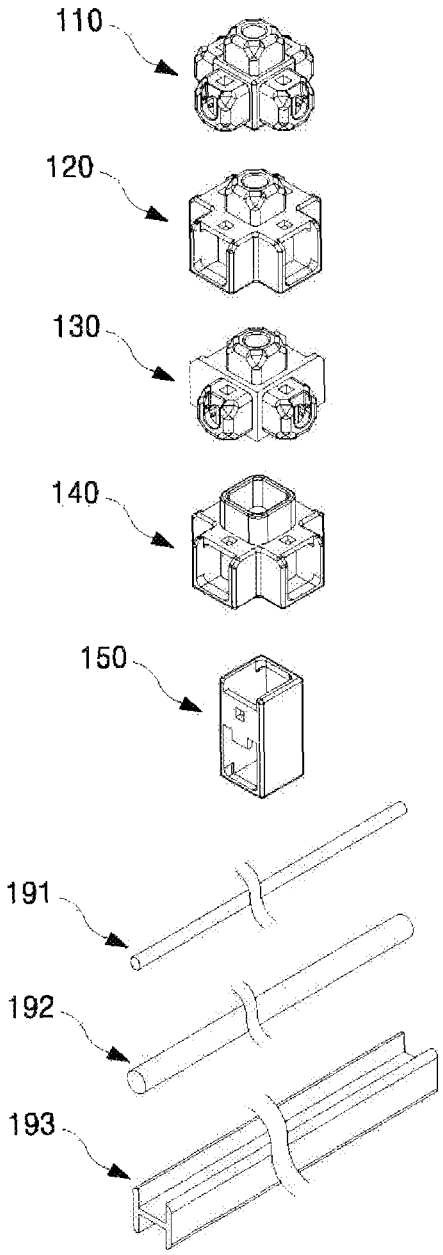
FIG. 1 shows components of a block assembly in accordance with one embodiment of the present disclosure.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Further, the use of "may" when describing embodiments of the present disclosure refers to "one or more embodiments of the present disclosure."

Hereinafter, embodiments of the present disclosure will be described in details with reference to attached drawings.

Figure 2:
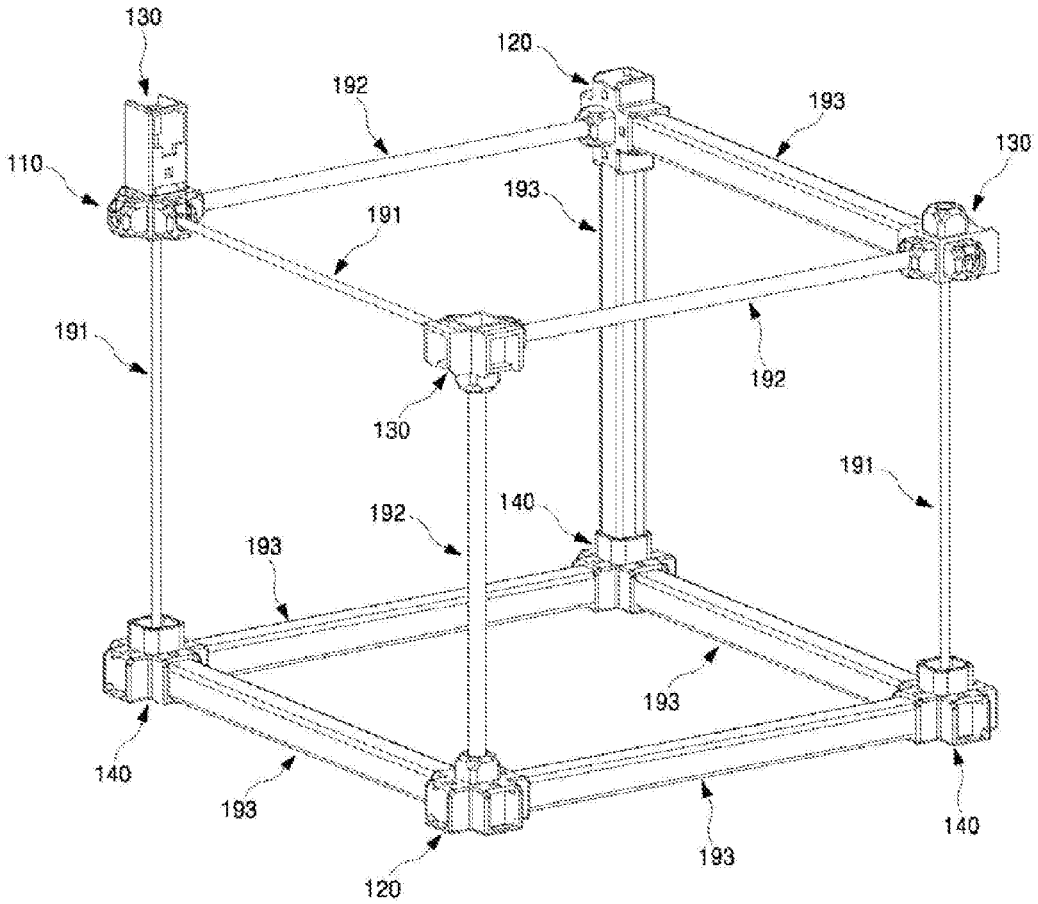
FIG. 2 is a perspective view of one example of a block assembly in accordance with one embodiment of the present disclosure.
Figure 3:
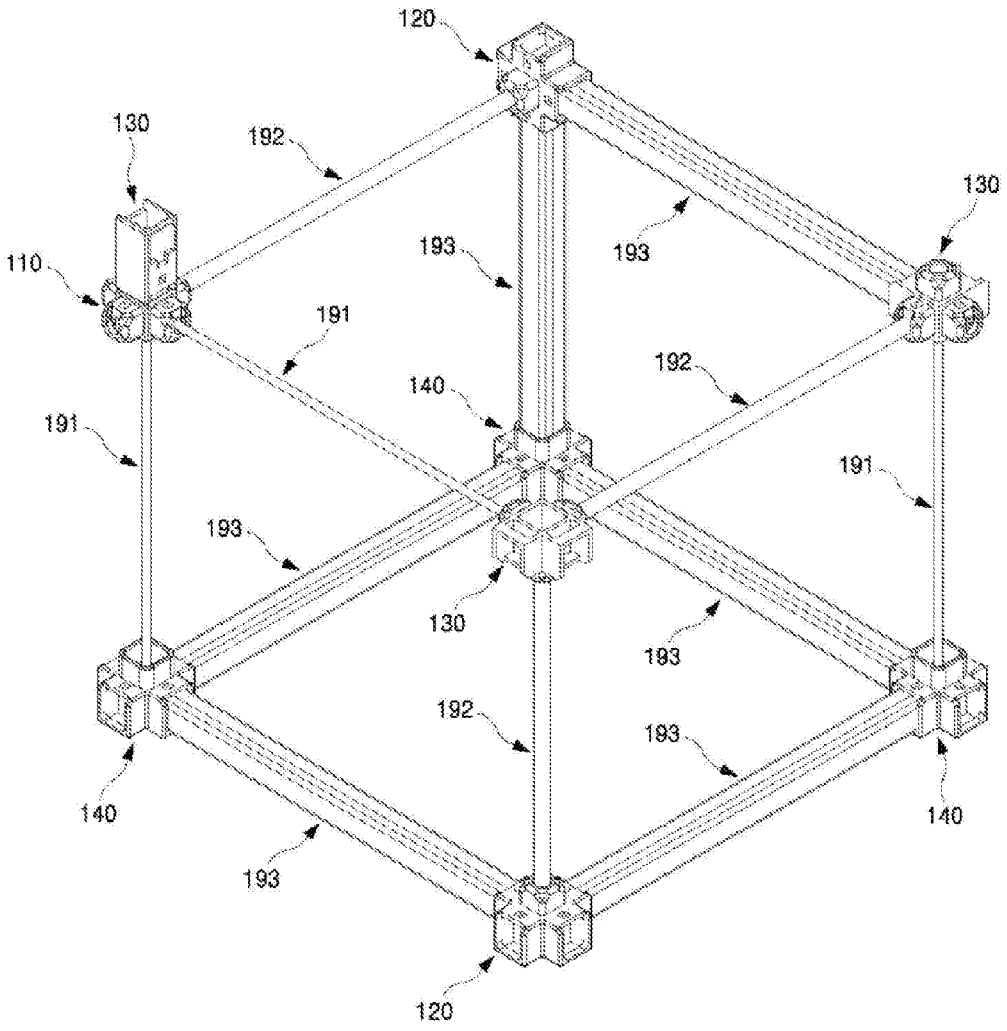
FIG. 3 is a perspective view of the assembly in FIG. 2 in a different view angel.
Figure 4:
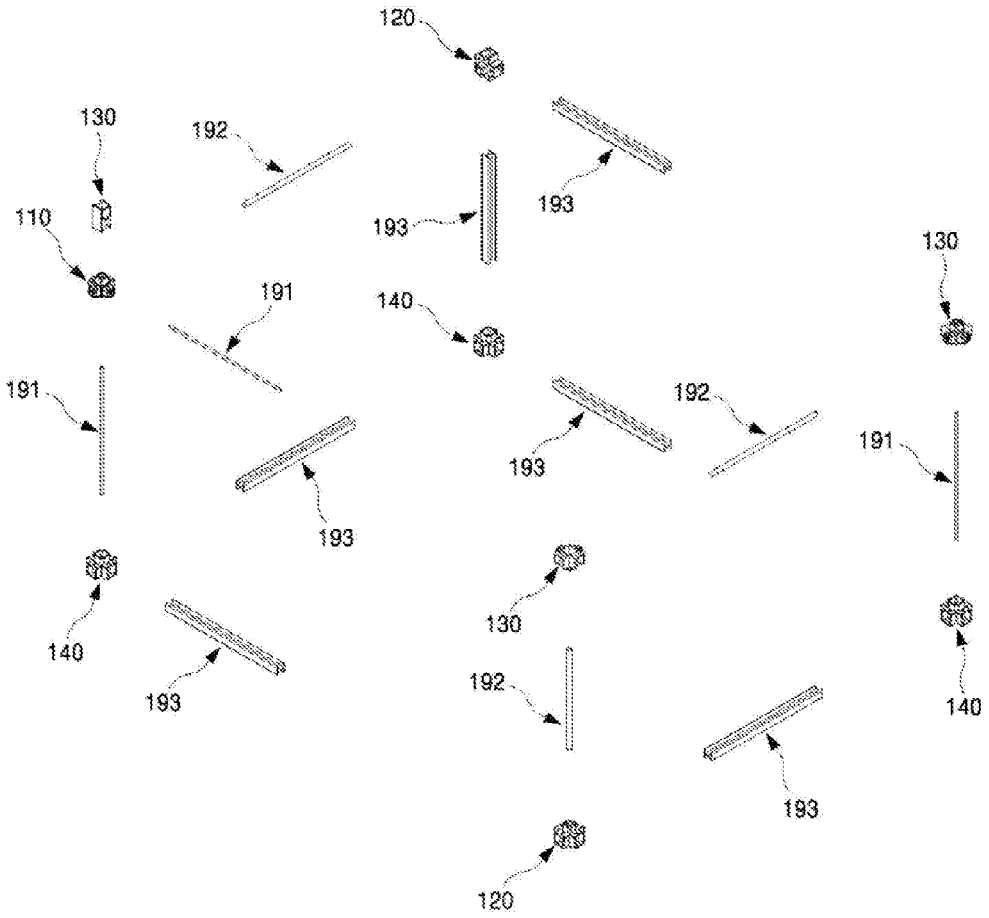
FIG. 4 is an exploded view of the assembly in FIG. 2.
Figure 5A:
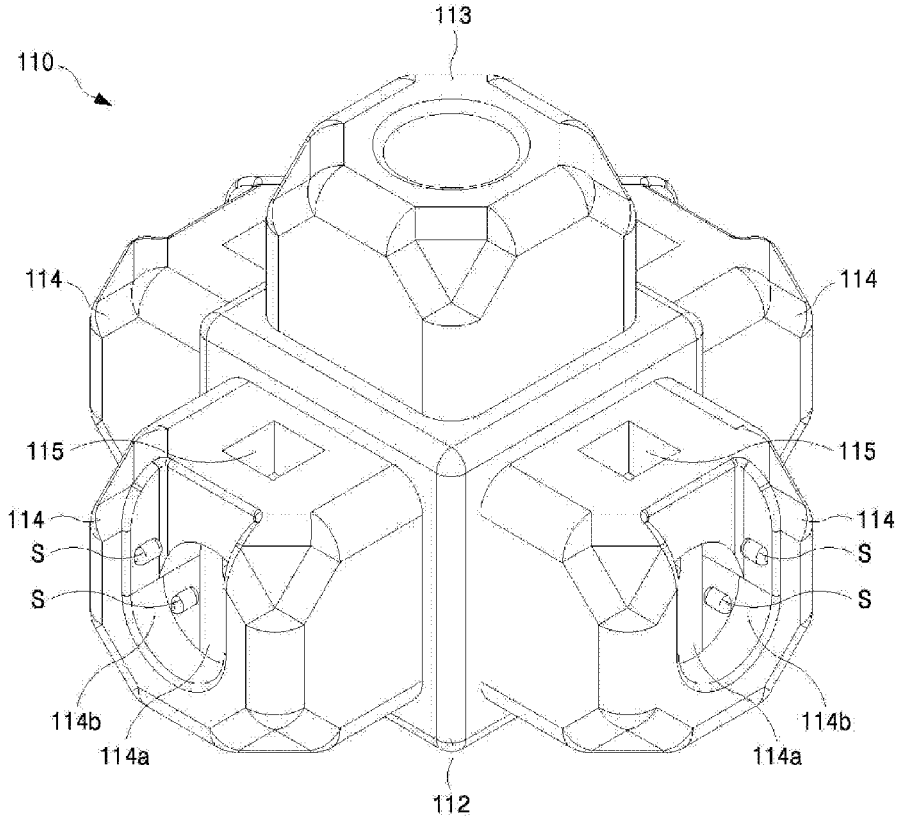
FIG. 5A to FIG. 5C are front and rear perspective and top views respectively of a first unit block in accordance with one embodiment of the present disclosure.
Figure 5B:
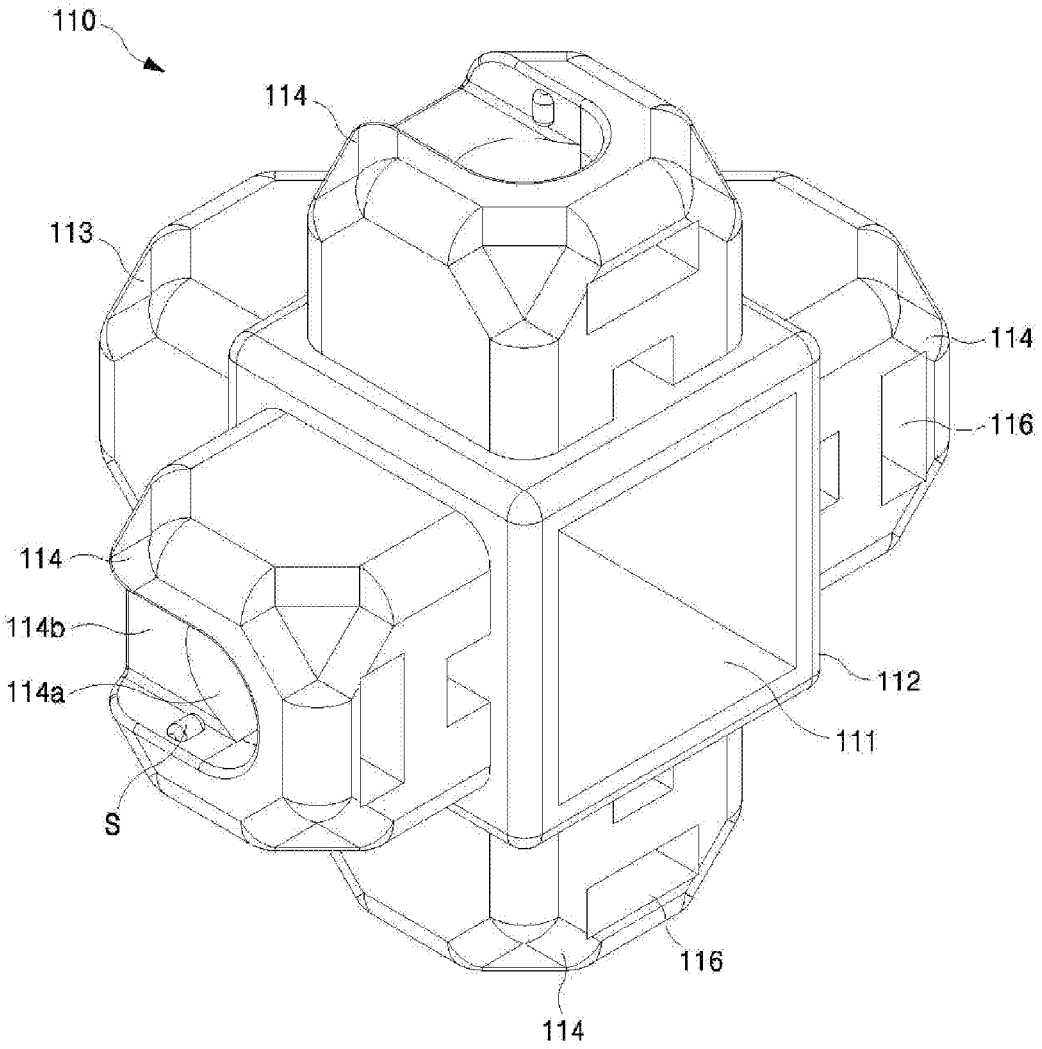
Figure 5C:
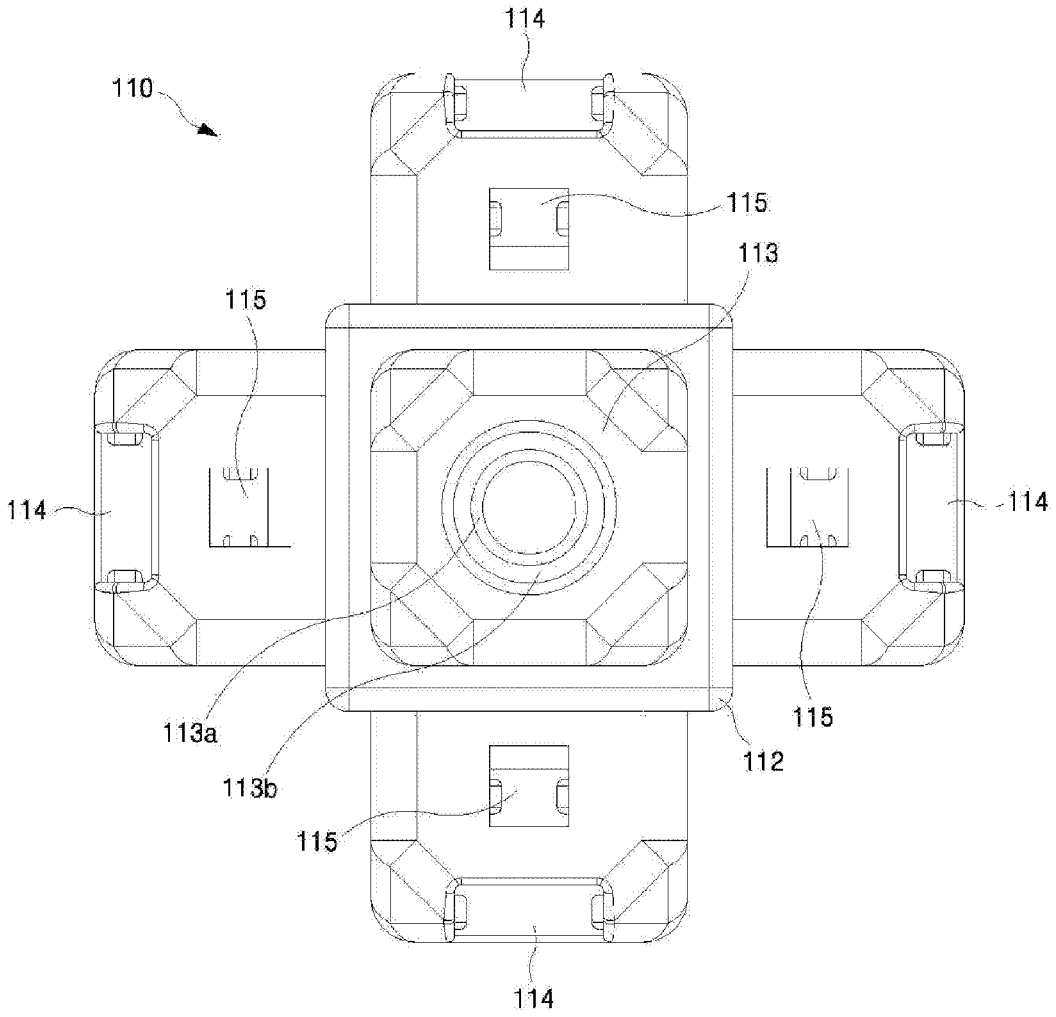
Figure 6A:
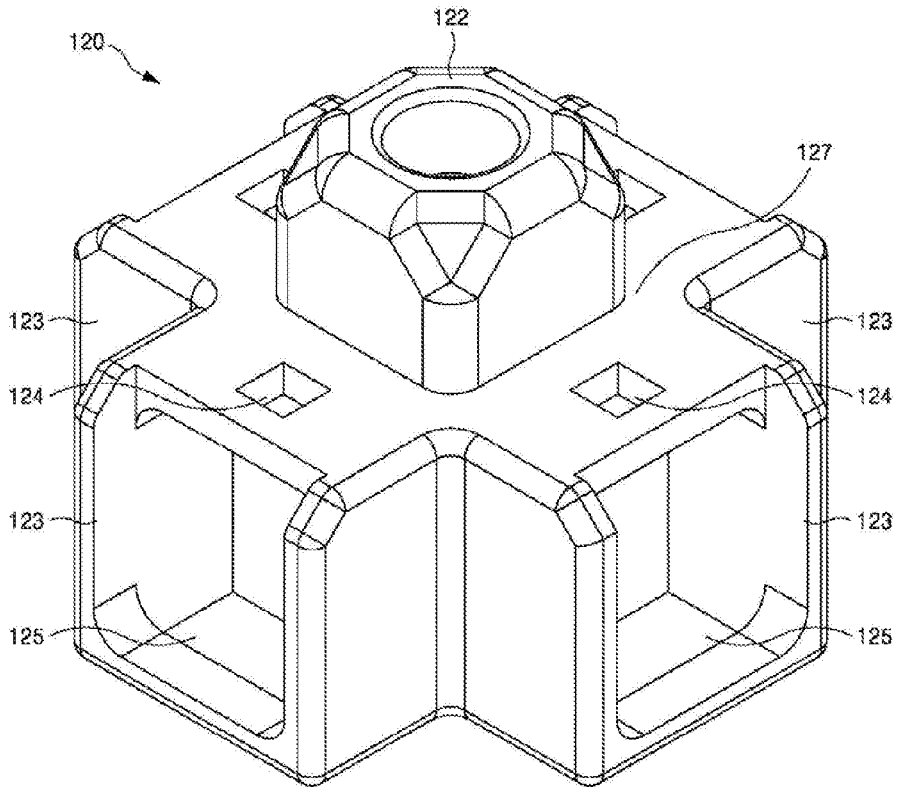
FIG. 6A to FIG. 6C are front and rear perspective and top views respectively of a second unit block in accordance with one embodiment of the present disclosure.
Figure 6B:
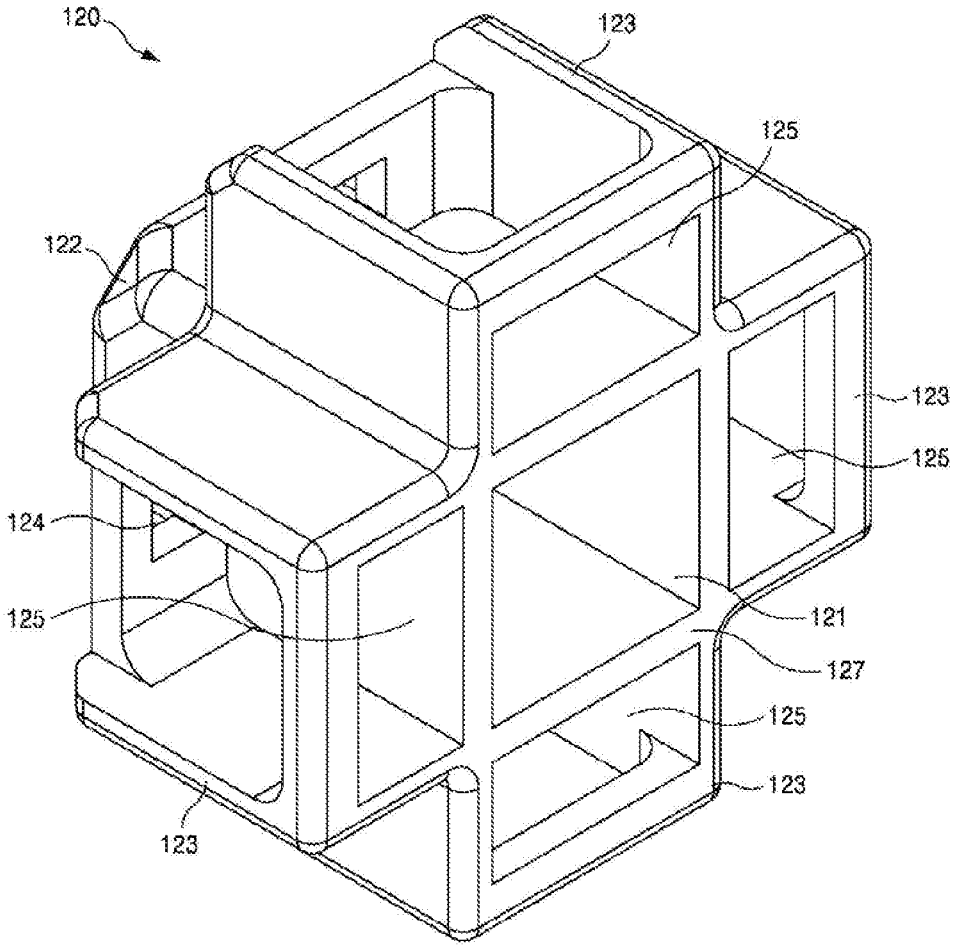
Figure 6C:
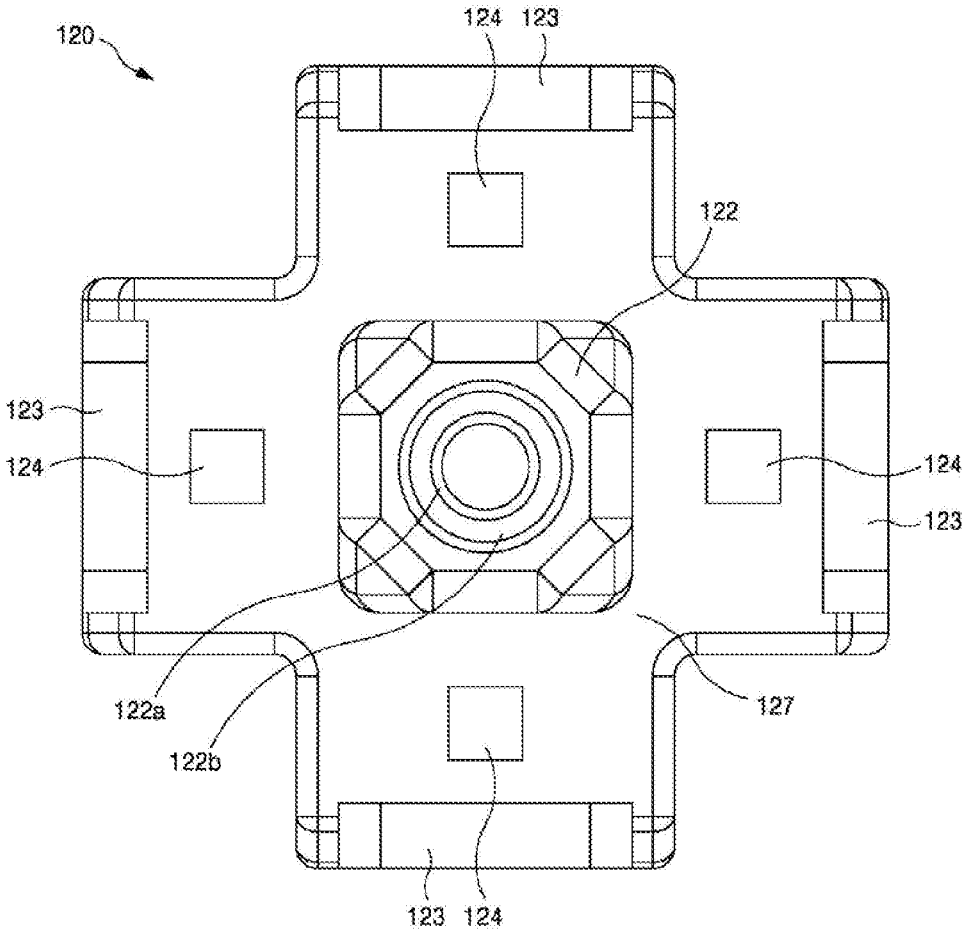
Figure 7A:
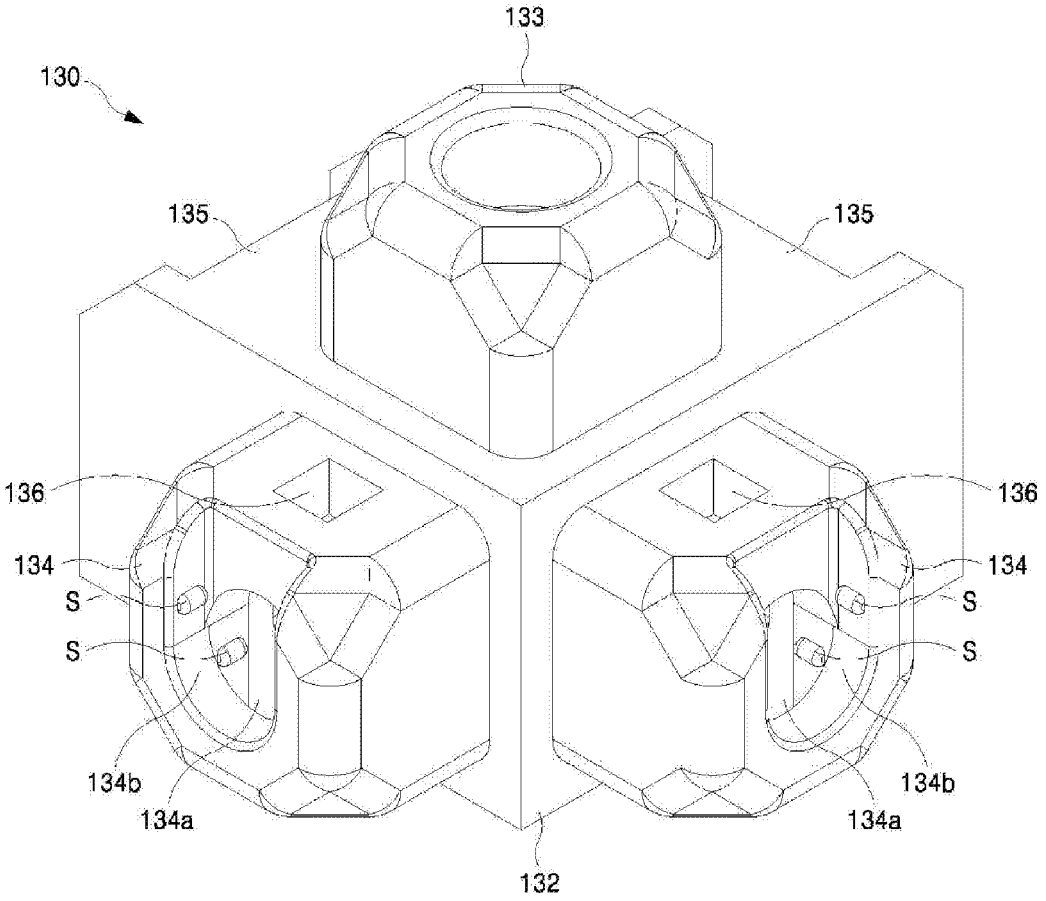
FIG. 7A to FIG. 7C are front and rear perspective and top views respectively of a third unit block in accordance with one embodiment of the present disclosure.
Figure 7B:
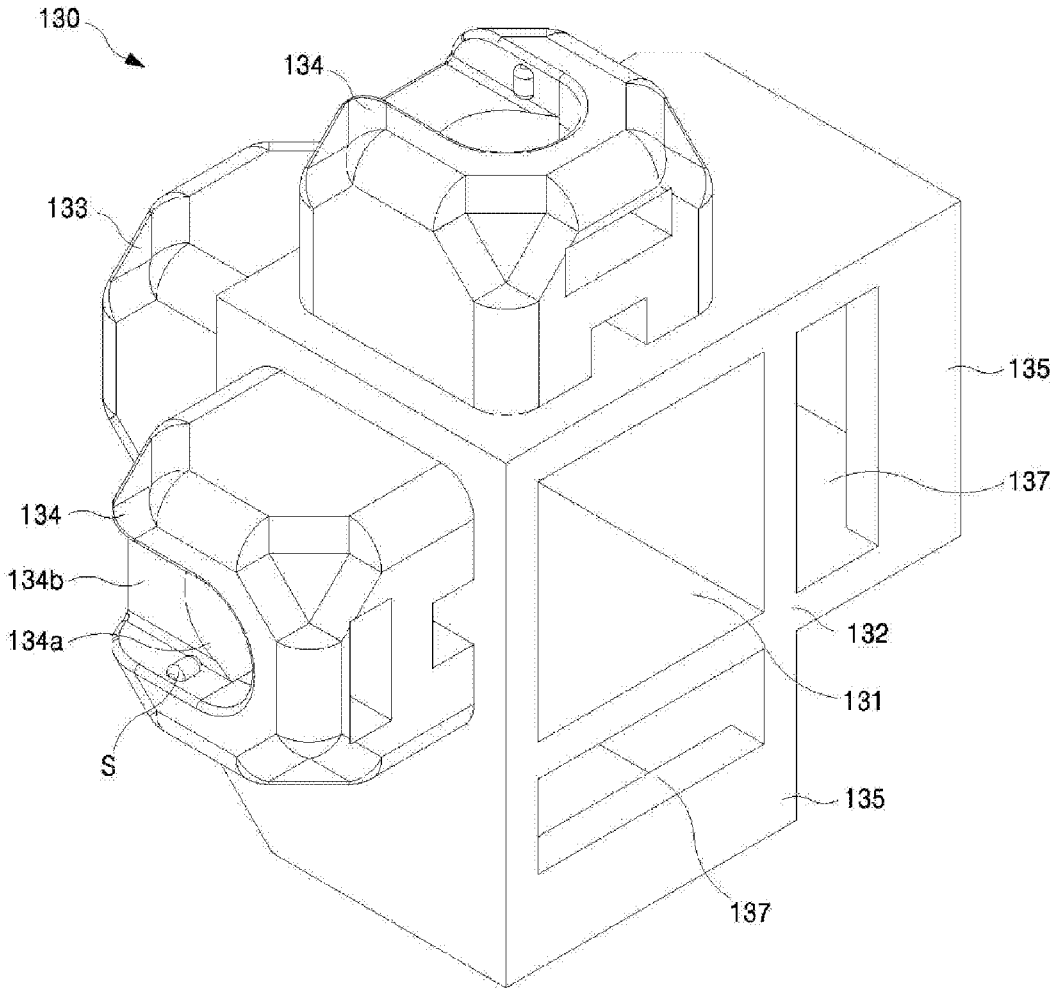
Figure 7C:
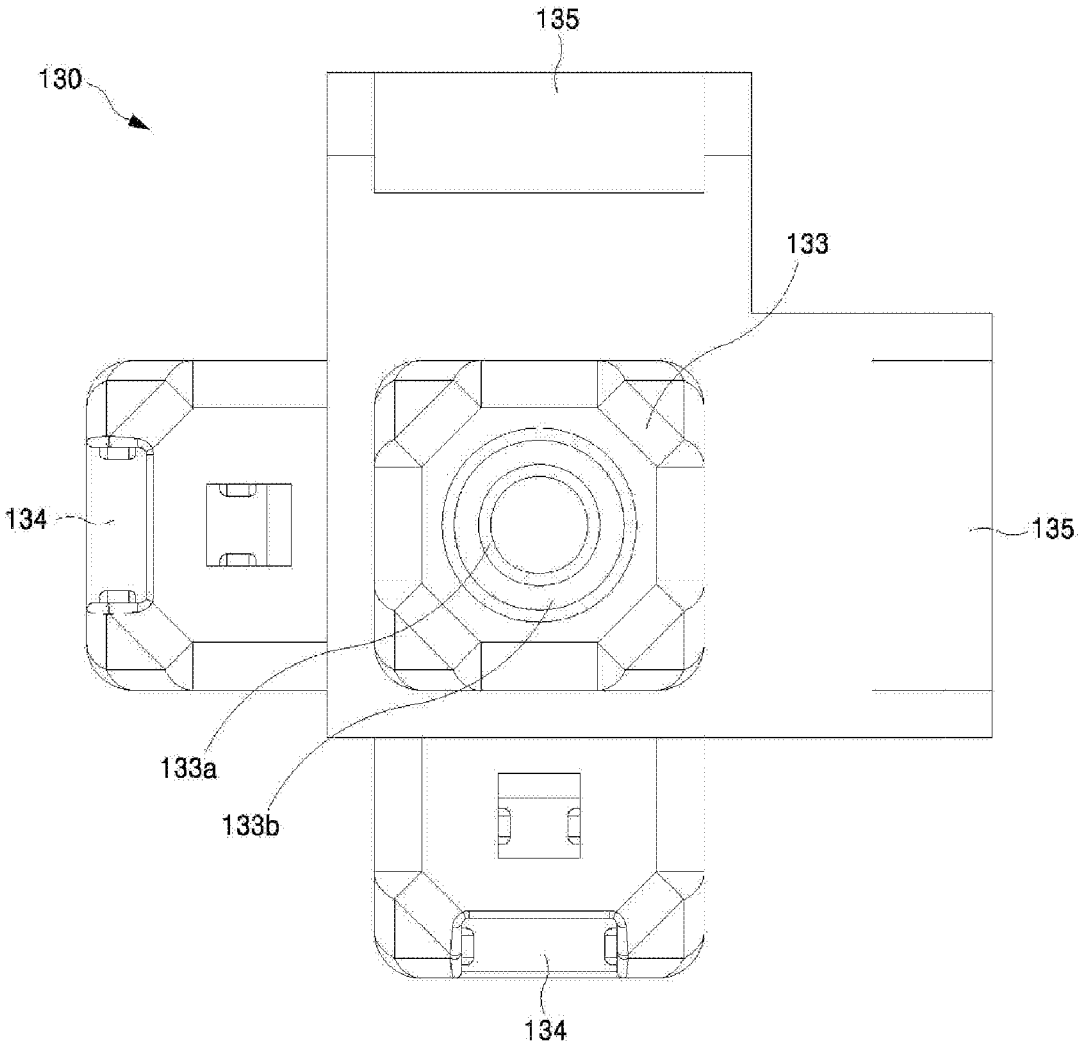
Figure 8A:
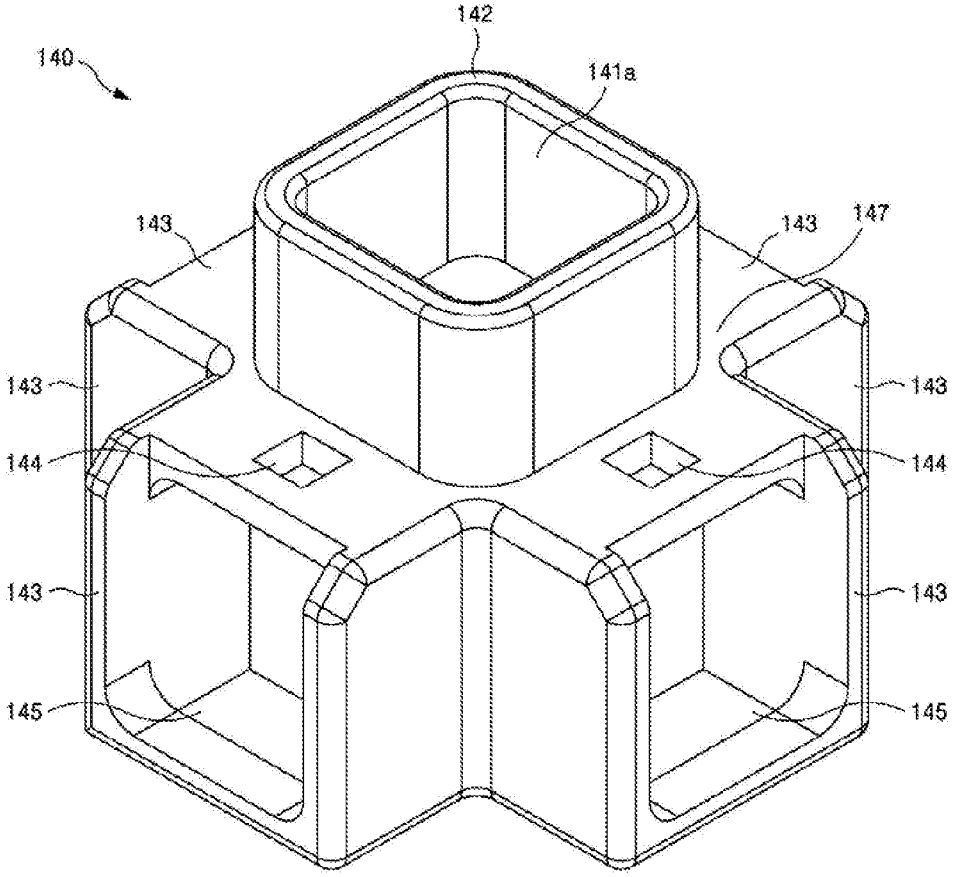
FIG. 8A to FIG. 8C are front and rear perspective and top views respectively of a fourth unit block in accordance with one embodiment of the present disclosure.
Figure 8B:
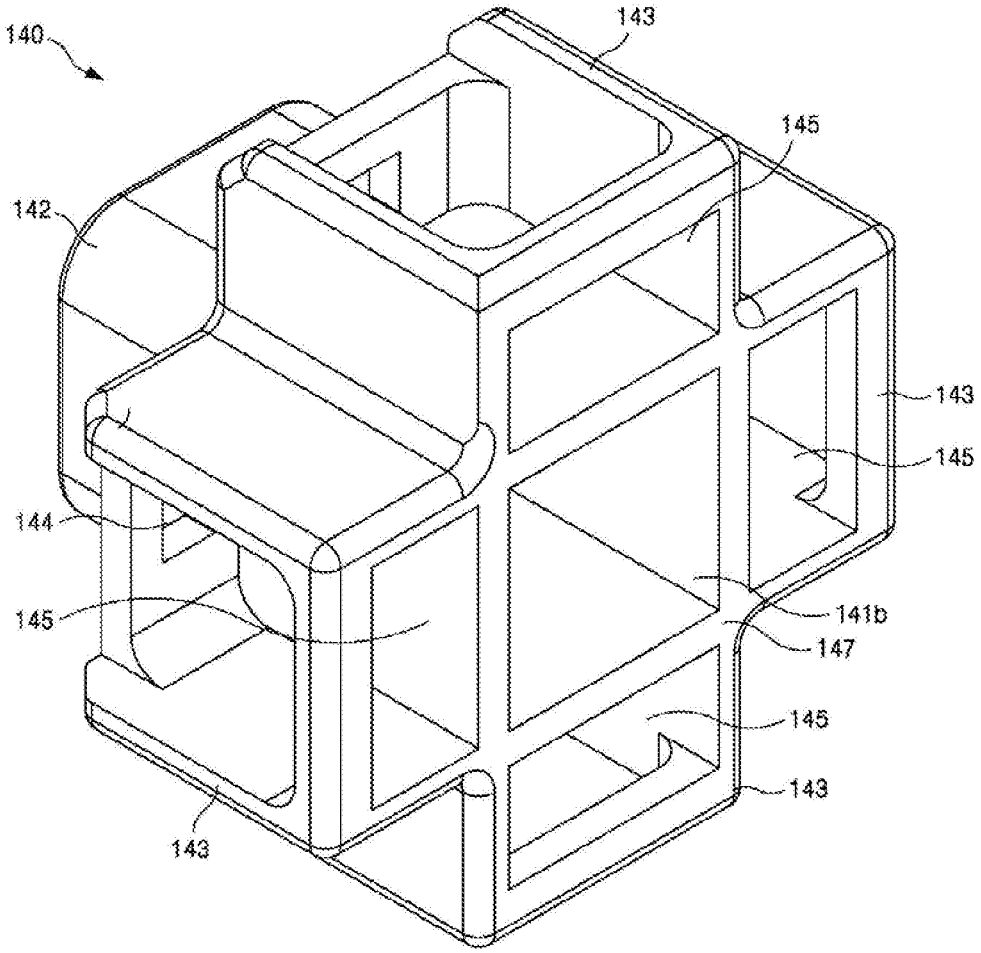
Figure 8C:
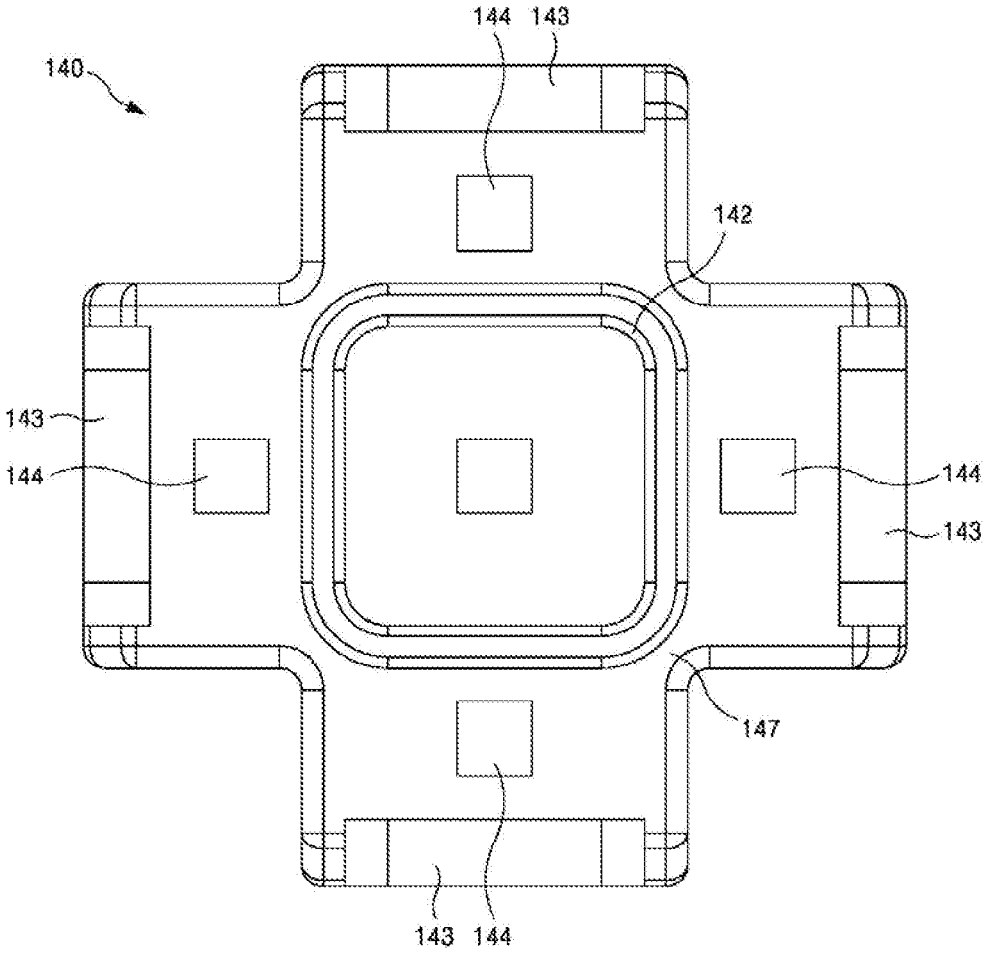
Figure 9A:
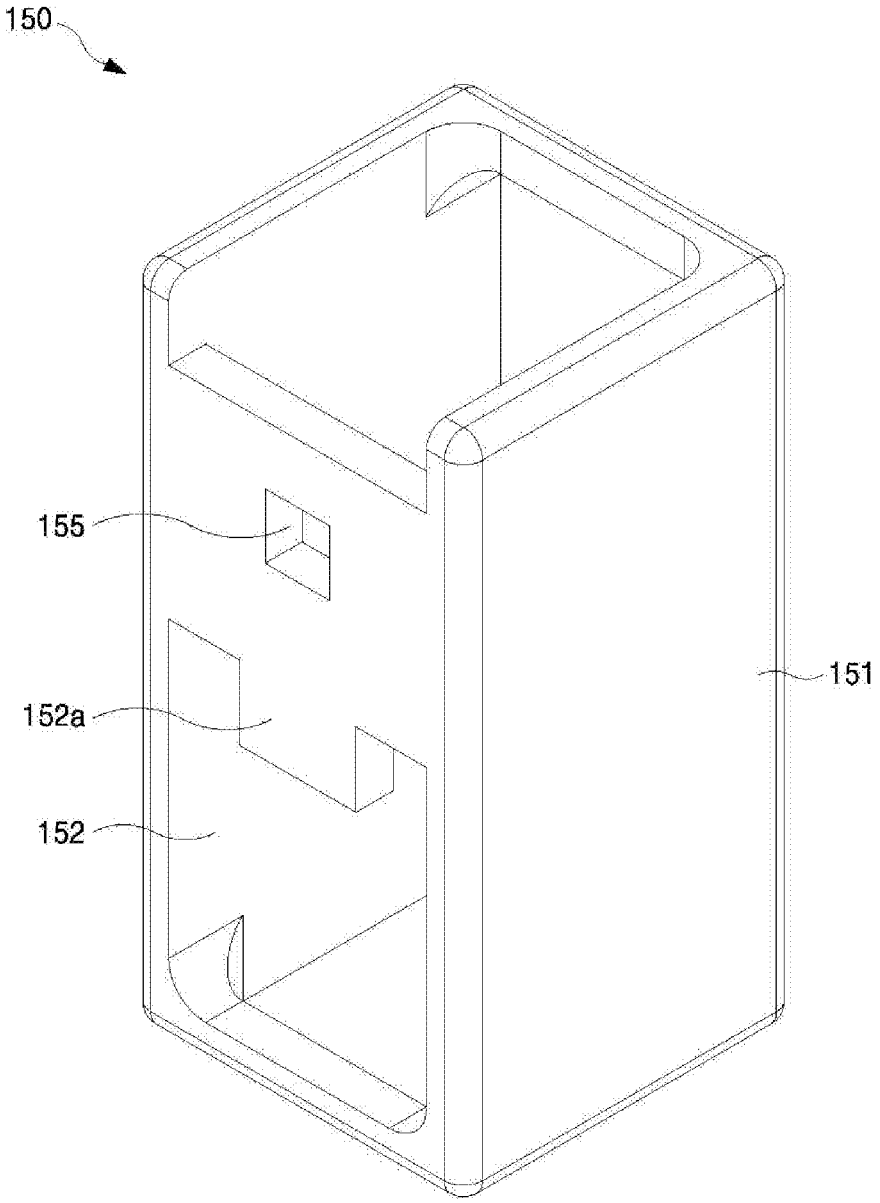
FIG. 9A and FIG. 9B are front and rear perspective views respectively of a beam connection in accordance with one embodiment of the present disclosure.
Figure 9B:
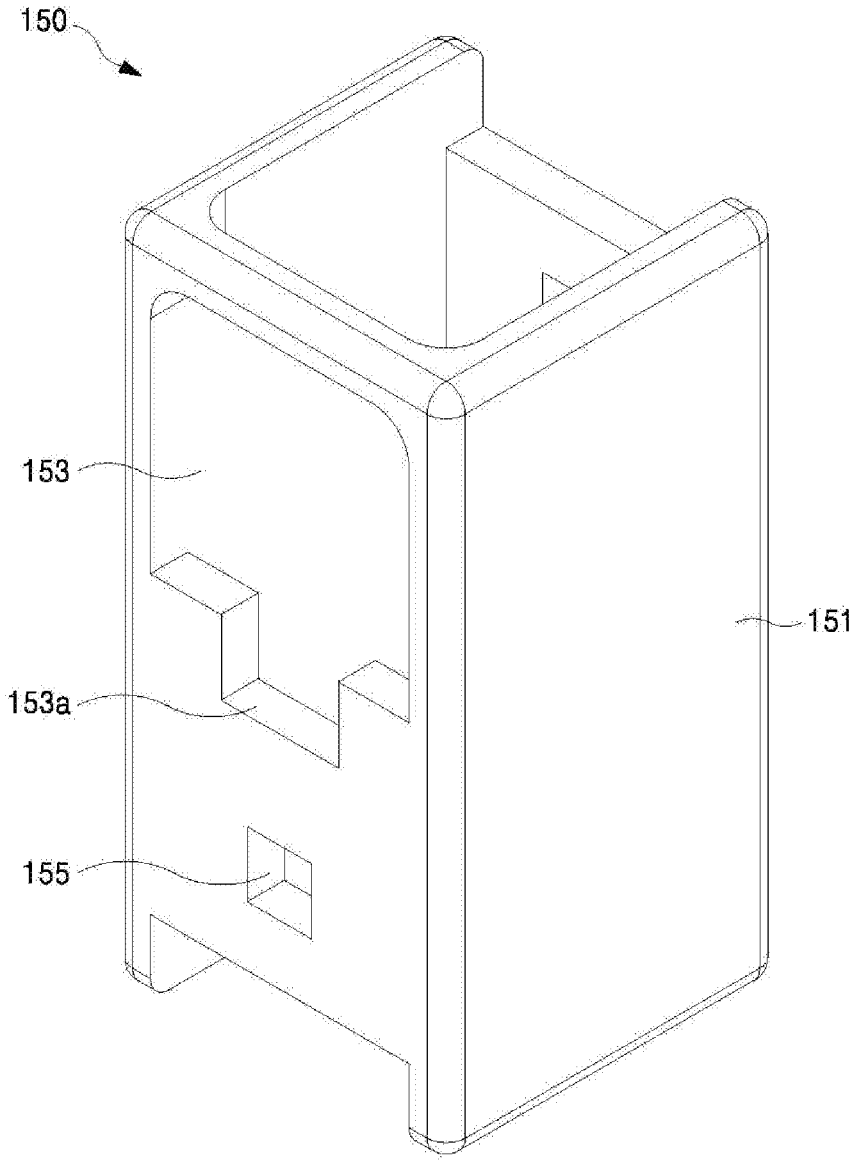
Figure 9C:
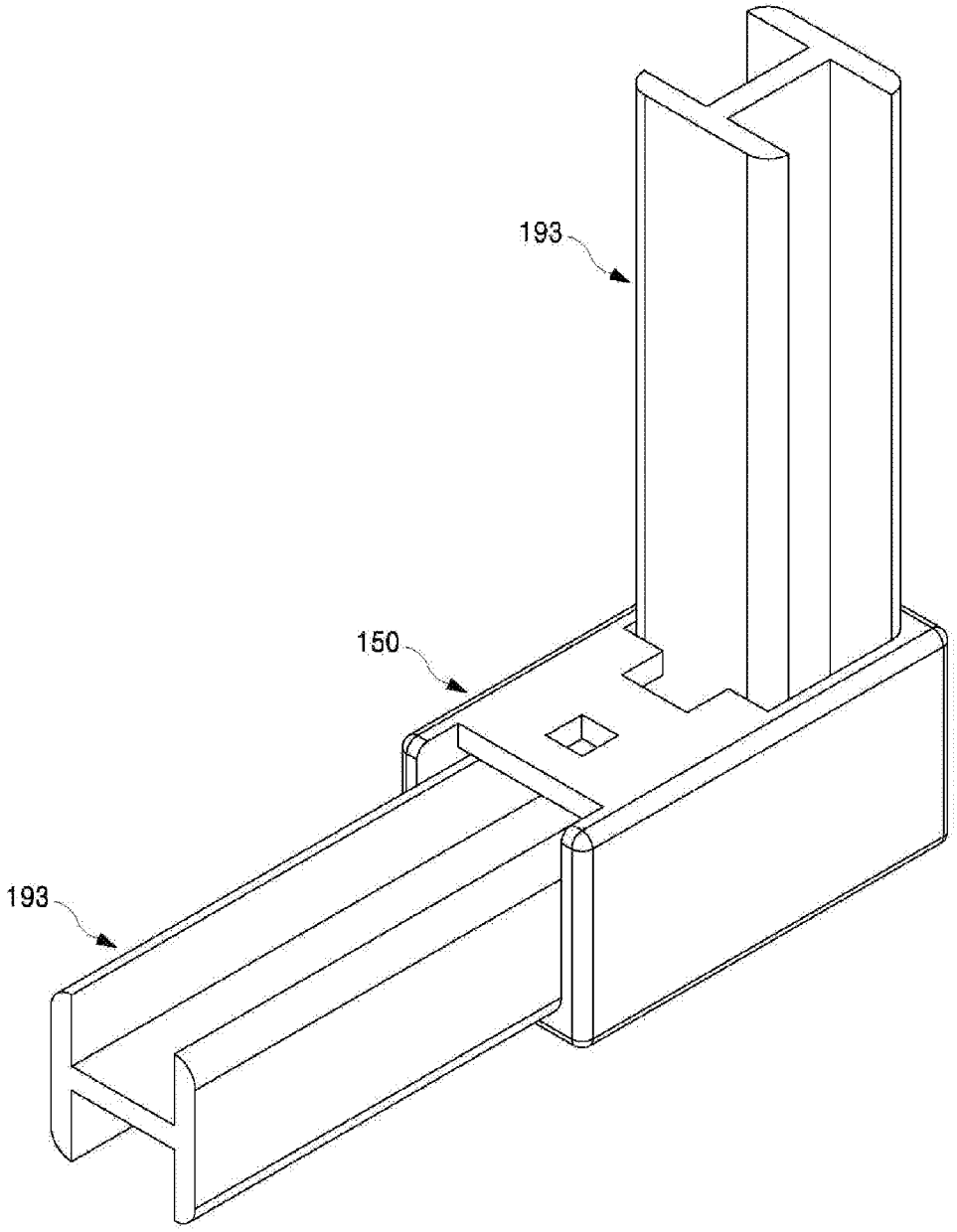
FIG. 9C shows one use example of a beam connection.

FIG. 1 shows components of a block assembly in accordance with one embodiment of the present disclosure. FIG. 2 is a perspective view of one example of a block assembly in accordance with one embodiment of the present disclosure. FIG. 3 is a perspective view of the assembly in FIG. 2 in a different view angel. FIG. 4 is an exploded view of the assembly in FIG. 2. FIG. 5A to FIG. 5C are front and rear perspective and top views respectively of a first unit block in accordance with one embodiment of the present disclosure. FIG. 6A to FIG. 6C are front and rear perspective and top views respectively of a second unit block in accordance with one embodiment of the present disclosure. FIG. 7A to FIG. 7C are front and rear perspective and top views respectively of a third unit block in accordance with one embodiment of the present disclosure. FIG. 8A to FIG. 8C are front and rear perspective and top views respectively of a fourth unit block in accordance with one embodiment of the present disclosure. FIG. 9A and FIG. 9B are front and rear perspective views respectively of a beam connection in accordance with one embodiment of the present disclosure. FIG. 9C shows one use example of a beam connection.

The assembly block set in accordance with one embodiment of the present disclosure may be applied not only to an educational purpose for children but also to a model architecture and a simple real building, etc.

Using the components as shown in FIG. 1, an exemplary model structure as shown in FIG. 2 and FIG. 3 may be formed. The present disclosure is not limited thereto.

The block assembly in accordance with one embodiment of the present disclosure may include components as shown in FIG. 1. The block assembly in accordance with one embodiment of the present disclosure may be assembled using at least two of a first rod 191 with a first cross sectional area, a second rod 192 with a second cross sectional area larger than the first cross sectional area, a H shaped beam 193, first to fourth unit blocks 110 to 140, and a beam connection 150.

The first rod 191 may have a variable length. The first rod 191 may be coupled to the first to third unit blocks 110 to 130. The first rod 191 may be solid or hollow.

The second rod 192 may have a variable length. The second rod 192 may be coupled to the first to third unit block 110 to 130. The second rod 191 may be solid or hollow.

The H shaped beam 193 may have a cross-section of a H shape. The H shaped beam 193 may be coupled to all of the first to fourth unit blocks 110 to 140, and the beam connection 150.

The first unit block 110 may include a first hexahedral body 112 having first to sixth side faces; a first H shaped beam receiving groove 111 defined from the first side face to receive the H shaped beam 193; a first main protrusion 113 protruding from the second side face opposite the first side face to be selectively coupled to the first rod 191 and second rod 192; and at least one of multiple first secondary protrusions 114 protruding from the third to sixth side faces of the first hexahedral body 112 respectively to be selectively coupled to the first rod 191 and second rod 192.

The first main protrusion 113 may have a first main first rod coupling protrusion 113*a* to be coupled to the first rod 191, and a first main second rod coupling protrusion 113*b* concentric with the first main first rod coupling protrusion 113*a* and surrounding the first main first rod coupling protrusion 113*a* to be coupled to the second rod 192.

For the first main protrusion 113, the first rod 191 may be inserted into the inner first main first rod coupling protrusion 113*a*, while the second rod 192 may be inserted into the outer first main second rod coupling protrusion 113*b*. The first rod 191 and second rod 192 may be selectively coupled to the first main protrusion 113. This may extend an application range of the first unit block 110.

The first secondary protrusion 114 may include a first secondary first rod coupling groove 114*a* to be coupled to the first rod 191, and a first secondary second rod coupling groove 114*b* concentric with the first secondary first rod coupling groove 114*a* and formed radially outside of the first secondary first rod coupling groove 114*a*. The second rod 192 may be slidably inserted into the first secondary second rod coupling groove 114*b* at an open side end thereof.

That is, the first rod 191 may be inserted vertically into the first secondary first rod coupling groove 114*a*, while the second rod 192 may be horizontally inserted into the first secondary second rod coupling groove 114*b*. Thus, the second rod 192 may be easily coupled.

In this connection, each of the first secondary first rod coupling groove 114*a* and first secondary second rod coupling groove 114*b* may have a stopper protrusion S. Thus, this may improve a friction force of the first rod 191 and second rod 192 to prevent the removal thereof.

The first unit block 110 may include the multiple first secondary protrusions 123 with the same shape. Further, the first unit block 110 may have first through-holes 115,116 formed in the multiple first secondary protrusions 114 to reduce a weight and a material cost.

Next, the second unit block 120 may include a second hexahedral body 127 having first to sixth side faces; a second H shaped beam receiving groove 121 defined in the body from the first side face to receive the H shaped beam 193 therein; a second main protrusion 122 extending from the second side face opposite the first side face to be selectively coupled to the first rod 191 and second rod 192; and at least one of multiple second secondary protrusions 123 extending from the third to sixth side faces respectively to be coupled to the H shaped beam 193.

The second main protrusion 122 may include a second main first rod coupling protrusion 122*a* to be coupled to the first rod 191, and a second main second rod coupling protrusion 122*b* concentric with the second main first rod coupling protrusion 122*a* and surrounding the second main first rod coupling protrusion 122*a* to be coupled to the second rod 192.

In this connection, the second unit block 120 may have the multiple second secondary protrusions 123 with the same shape. Each of the multiple second secondary protrusions 123 of the second unit block 120 may have second through-holes 124,125 formed therein to reduce the weight and material cost.

The third unit block 130 may include a third hexahedral body 132 having first to sixth side faces; a third H shaped beam receiving groove 131 formed in the third hexahedral body 132 from the first side face to receive the H shaped beam 193; a third main protrusion 133 extending from the second side face opposite the first side face to be selectively coupled to the first rod 191 and second rod 192; at least one of multiple third secondary protrusions 134 extending from the third to fifth side faces respectively to be selectively coupled to the first rod 191 and second rod 192; a third H shaped beam coupling protrusion 135 extending from the sixth face to be coupled to the H shaped beam 193.

The third main protrusion 133 may have a third main first rod coupling protrusion 133*a* coupled to the first rod 191, and a third main second rod coupling protrusion 133*b* concentric with the third main first rod coupling protrusion 133*a* and surrounding the third main first rod coupling protrusion 133*a* to be coupled to the second rod 192.

That is, the first rod 191 may be inserted in the inner protrusion in the third main protrusion 133, and the second rod 192 may be inserted in the outer protrusion in the third main protrusion 133. This may allow a selective coupling between the first rod 191 and second rod 192. This may extend the application range of the third unit block.

Each of the third secondary protrusions 134 may include a third secondary first rod coupling groove 134*a* into which the first rod 191 is vertically inserted; a third secondary second rod coupling groove 134*b* concentric with the third secondary first rod coupling groove 134*a* and disposed radially out of the third secondary first rod coupling groove 134*a*. The second rod 192 may be horizontally inserted into the third secondary second rod coupling groove 134*b* from one open side end thereof.

That is, the first rod 191 is vertically inserted into the third secondary first rod coupling groove 134*a*, while the second rod 192 is horizontally inserted into the third secondary second rod coupling groove 134*b*. Thus, the second rod 192 may be easily coupled.

In this connection, each of the third secondary first rod coupling groove 134*a* and third secondary second rod coupling groove 134*b* may have a stopper protrusion S. Thus, this may improve a friction force of the first rod 191 and second rod 192 to prevent the removal thereof.

The third unit block 130 may have the multiple second secondary protrusions 134 with the same shape. Each of the multiple third secondary protrusions 134 may have third through-holes 136,137 formed therein to reduce a weight and a material cost.

In one variant, in the third unit block 130, two pairs of the adjacent second secondary protrusion 123 and third H shaped beam coupling protrusion 135 may be possible.

Next, the fourth unit block 140 may include a fourth hexahedral body 147 having first to sixth side faces; a fourth H shaped beam receiving groove 141*b* formed in the body 147 from the first side face to receive the H shaped beam 193; a fourth main protrusion 142 extending from the second side face opposite the first side, wherein the fourth main protrusion 142 has a fourth H shaped beam receiving groove 141*a* defined therein; at least one of multiple fourth secondary protrusions 143 extending from the third to sixth side faces respectively to be coupled to the H shaped beam 193.

In this connection, in the fourth unit block 140, the multiple fourth secondary protrusions 143 with the same shape may have fourth through-holes 144,145 defined therein to reduce the weight and material cost.

Finally, the beam connection 150 may be configured to connect the two H shaped beams 193 in a linear or perpendicular way.

That is, the H shaped beam 193 may have a unit length. Thus, to extend the length of H shaped beam 193, or to allow an intersection between two H shaped beams 193, the beam connection 150 may be used.

The beam connection 150 may have a hollow frame 151, a first H shaped beam through-hole 152 formed in the hollow frame 151 at a first side face, and a second H shaped beam through-holes 153 formed in the hollow frame 151 at a second side face opposite the first side face. The second H shaped beam through-holes 153 may be diagonal to the first H shaped beam through-holes 152.

In this connection, from the first H shaped beam through-hole 152 portion, a rib 152*a* may protrude. In the second H shaped beam through-hole 153 portion, a rib 153*a* may be recessed. Thus, the H shaped beam 193 may be retained effectively.

Each of portions of the first H shaped beam through-holes 152 and second H shaped beam through-holes 153 may have a hole 155 to reduce a weight.

The beam connection 150 may allow a linear connection between the H shaped beams 193 or may realize a right-angled connection between the H shaped beams 193 as shown in FIG. 9C. This may provide great freedom of the assembly.

An assembly of at least two of the first rod 191, second rod 192, H shaped beam 193, first to fourth unit blocks 110 to 140, and, beam connection 150 may result in the structures as shown in FIG. 2 and FIG. 3. The present disclosure is not limited thereto. An assembly of at least two of the first rod 191, second rod 192, H shaped beam 193, first to fourth unit blocks 110 to 140, and, beam connection 150 may result in various structured assemblies.

The present block assembly may be applied to an educational purpose for the children and a model architecture and a simple real building. The present disclosure is not limited thereto.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A block assembly comprising:

a plurality of first-rods, each first-rod having a first cross sectional area, wherein each first-rod is solid or hollow;

a plurality of second-rods, each second-rod having a second cross sectional area larger than the first cross sectional area, wherein each second-rod is solid or hollow;

a plurality of H shaped beams, each having a H shaped cross section; and at least one of first to fourth unit blocks;

wherein the first unit block includes:

a first hexahedral body having first to sixth side faces;

a first H shaped beam receiving groove defined in the first body from the first side face to receive the H shaped beam;

a first main protrusion protruding from the second side face opposite the first side face to be selectively coupled to the first-rod and second-rod; and at least one of multiple first secondary protrusions protruding from the third to sixth side faces of the first hexahedral body respectively to be selectively coupled to the first-rod and second-rod, wherein the second unit block includes:

a second hexahedral body having first to sixth side faces;

a second H shaped beam receiving groove defined in the second body from the first side face to receive the H shaped beam therein;

a second main protrusion extending from the second side face opposite the first side face to be selectively coupled to the first-rod and second-rod;

and at least one of multiple second secondary protrusions extending from the third to sixth side faces respectively to be coupled to the H shaped beam, wherein the third unit block includes:

a third hexahedral body having first to sixth side faces;

a third H shaped beam receiving groove formed in the third hexahedral body from the first side face to receive the H shaped beam;

a third main protrusion extending from the second side face opposite the first side face to be selectively coupled to the first-rod and second-rod;

at least one of multiple third secondary protrusions extending from the third to fifth side faces respectively to be selectively coupled to the first-rod and second-rod; and a third H shaped beam coupling protrusion extending from the sixth face to be coupled to the H shaped beam, wherein the fourth unit block includes:

a fourth hexahedral body having first to sixth side faces;

a fourth H shaped beam receiving groove formed in the fourth body from the first side face to receive the H shaped beam;

a fourth main protrusion extending from the second side face opposite the first side, wherein the fourth main protrusion has a fourth H shaped beam receiving groove defined therein; and at least one of multiple fourth secondary protrusions extending from the third to sixth side faces respectively to be coupled to the H shaped beam.

2. The assembly of claim 1, wherein the first main protrusion includes:

a first main first-rod coupling protrusion to be coupled to the first-rod; and a first main second-rod coupling protrusion concentric with the first main first-rod coupling protrusion and surrounding the first main first-rod coupling protrusion, wherein the first main second-rod coupling protrusion is coupled to the second-rod.

3. The assembly of claim 1, wherein the first secondary protrusion includes:

a first secondary first-rod coupling groove in which the first-rod is vertically inserted; and a first secondary second-rod coupling groove concentric with the first secondary first-rod coupling groove and formed radially outside of the first secondary first-rod coupling groove, wherein the second-rod is horizontally inserted into the first secondary second-rod coupling groove from an open side end thereof.

4. The assembly of claim 3, wherein each of the first secondary first-rod coupling groove portion and the first secondary second-rod coupling groove portion has a stopper protrusion.

5. The assembly of claim 1, wherein the multiple first secondary protrusions have the same shape, and wherein the first unit block has first through-holes formed in the multiple first secondary protrusions to reduce a weight.

6. The assembly of claim 1, wherein the second main protrusion includes:

a second main first-rod coupling protrusion to be coupled to the first-rod; and a second main second-rod coupling protrusion concentric with the second main first-rod coupling protrusion and surrounding the second main first-rod coupling protrusion, wherein the second main second-rod coupling protrusion is coupled to the second-rod.

7. The assembly of claim 1, wherein the multiple second secondary protrusions have the same shape, and each of the multiple second secondary protrusions of the second unit block have second through-holes formed therein to reduce a weight.

8. The assembly of claim 1, wherein the third main protrusion includes:

a third main first-rod coupling protrusion coupled to the first-rod; and a third main second-rod coupling protrusion concentric with the third main first-rod coupling protrusion and surrounding the third main first-rod coupling protrusion, wherein the third main second-rod coupling protrusion is coupled to the second-rod.

9. The assembly of claim 1, wherein each of the third secondary protrusions includes:

a third secondary first-rod coupling groove into which the first-rod is vertically inserted; and a third secondary second-rod coupling groove concentric with the third secondary first-rod coupling groove and formed radially out of the third secondary first-rod coupling groove, wherein the second-rod is horizontally inserted into the third secondary second-rod coupling groove from one open side end thereof.

10. The assembly of claim 9, wherein each of the third secondary first-rod coupling groove portion and the third secondary second-rod coupling groove portion has a stopper protrusion.

11. The assembly of claim 1, wherein the multiple third secondary protrusions have the same shape, and each of the multiple third secondary protrusions has third through-holes formed therein to reduce a weight.

12. The assembly of claim 1, wherein the multiple fourth secondary protrusions have the same shape and each of the multiple fourth secondary protrusions fourth through-holes defined therein to reduce a weight.

13. The assembly of claim 1, further comprising a beam connection, wherein the beam connection is configured to connect at least two H shaped beams in a linear and/or perpendicular way.

14. The assembly of claim 13, wherein the beam connection includes:

a hollow frame;

a first H shaped beam through-hole formed in the hollow frame at a first side face; and a second H shaped beam through-holes formed in the hollow frame at a second side face opposite the first side face, wherein the second H shaped beam through-holes is diagonal to the first H shaped beam through-holes.

15. The assembly of claim 14, wherein from the first H shaped beam through-hole portion, a first rib protrudes, wherein in the second H shaped beam through-hole portion, a second rib is recessed.

* * * * *